US009777408B2

(12) United States Patent
Irisawa et al.

(10) Patent No.: US 9,777,408 B2
(45) Date of Patent: Oct. 3, 2017

(54) PRECURSOR FIBER FOR CARBON FIBERS, CARBON FIBER, AND METHOD FOR PRODUCING CARBON FIBER

(71) Applicant: National Institute of Advanced Industrial Science and Technology, Tokyo (JP)

(72) Inventors: Toshihira Irisawa, Ibaraki (JP); Hiroaki Hatori, Ibaraki (JP); Yasushi Soneda, Ibaraki (JP); Masaya Kodama, Ibaraki (JP)

(73) Assignee: National Institute of Advanced Industrial Science and Technology, Tokyo (JP)

( * ) Notice: Subject to any disclaimer, the term of this patent is extended or adjusted under 35 U.S.C. 154(b) by 0 days.

(21) Appl. No.: 14/647,206

(22) PCT Filed: Nov. 25, 2013

(86) PCT No.: PCT/JP2013/081629
§ 371 (c)(1),
(2) Date: Jun. 30, 2015

(87) PCT Pub. No.: WO2014/084164
PCT Pub. Date: Jun. 5, 2014

(65) Prior Publication Data

US 2015/0322593 A1 Nov. 12, 2015

(30) Foreign Application Priority Data

Nov. 27, 2012 (JP) ..... 2012-258080

(51) Int. Cl.
*D01F 9/24* (2006.01)
*D01F 6/74* (2006.01)
(Continued)

(52) U.S. Cl.
CPC ..... *D01F 6/74* (2013.01); *D01F 9/24* (2013.01); *D01F 6/605* (2013.01); *D01F 9/30* (2013.01)

(58) Field of Classification Search
CPC ..... D01F 9/24; D01F 6/74; D01F 31/00
See application file for complete search history.

(56) References Cited

U.S. PATENT DOCUMENTS 3,414,543 A 12/1968 Paufler
3,539,677 A 11/1970 Steinberg et al.
(Continued)

FOREIGN PATENT DOCUMENTS

EA 201071185 4/2011
JP 49-054629 5/1974
(Continued)

OTHER PUBLICATIONS

Human English translation of JP49-054629A.*
(Continued)

*Primary Examiner* — Richard M Rump
(74) *Attorney, Agent, or Firm* — Carmody Torrance Sandak & Hennessey LLP

(57) ABSTRACT

To provide a carbon fiber precursor fiber that can efficiently produce a carbon fiber excellent in mechanical strength without an infusibilization treatment; a carbon fiber; and a method for producing the carbon fiber.
(Continued)

The carbon fiber precursor fiber includes a polymer represented by General Formula (1) below:

General Formula (1)

where in the General Formula (1), $Ar_1$ represents an aryl group expressed by any one of Structural Formulas (1) to (5) below, and $Ar_2$ represents an aryl group expressed by Structural Formula (6) or (7) below:

Structural Formula (1)

Structural Formula (2)

Structural Formula (3)

Structural Formula (4)

Structural Formula (5)

-continued

Structural Formula (6)

Structural Formula (7)

8 Claims, 6 Drawing Sheets

(51) Int. Cl.
*D01F 6/60* (2006.01)
*D01F 9/30* (2006.01)

(56) References Cited

U.S. PATENT DOCUMENTS

| | | | |
|---|---|---|---|
| 3,575,941 | A | 4/1971 | Steinberg |
| 3,903,248 | A | 9/1975 | Kalnin et al. |
| 4,915,984 | A | 4/1990 | Murakami |
| 2011/0038788 | A1 | 2/2011 | Tanaka et al. |
| 2012/0187422 | A1 | 7/2012 | Fujioka et al. |

FOREIGN PATENT DOCUMENTS

| | | |
|---|---|---|
| JP | 49-54629 | 5/1974 |
| JP | 01-057044 | 12/1989 |
| JP | 02-99615 | 4/1990 |
| JP | 2600088 | 1/1997 |
| JP | 2600088 | 4/1997 |
| JP | 2006-144201 | 6/2006 |
| JP | 2011-57474 | 3/2011 |
| RU | 2424385 | 7/2011 |

OTHER PUBLICATIONS

Russian office action dated Jun. 29, 2016 issued in connection with the corresponding Russian application.
Extended European Search Report dated Jun. 29, 2016 for corresponding EP application.

* cited by examiner

PRECURSOR FIBER FOR CARBON FIBERS, CARBON FIBER, AND METHOD FOR PRODUCING CARBON FIBER

TECHNICAL FIELD

The present invention relates to: a carbon fiber precursor fiber using a novel heat-resistant aromatic polymer and needing no infusibilization treatment (a pre-treatment including a flame resistance-imparting treatment); a carbon fiber; and a method for producing a carbon fiber.

BACKGROUND ART

Carbon fibers have been used in a wide variety of applications from aircraft to building materials. If their productivity is improved and their cost is lowered more and more, they can be materials in place of stainless steel plates also in automobile body and the like. At present, carbon fibers are mainly produced using polyacrylonitrile (PAN) fibers and pitch fibers as raw materials (carbon fiber precursor fibers).

These carbon fiber precursor fibers, however, need a pre-treatment called an infusibilization treatment prior to carbonization, and this treatment is a major barrier to reduction in cost and energy required for their production, and to increase in productivity.

Specifically, since PAN fibers and pitch fibers are fused in the course of a carbonization treatment (a high-temperature thermal treatment at 1,000° C. or higher) and cannot maintain their fiber shapes, they are changed to infusible, flame-resistant fibers by an air oxidization treatment called an infusibilization treatment and then are subjected to carbonization to obtain carbon fibers. In this infusibilization treatment, it is necessary to uniformly control oxidation reaction and also strictly manage temperature conditions for suppressing thermal runaway due to exothermic reaction, and moreover its treatment time is long (about 30 minutes to about 1 hour).

Meanwhile, some kinds of heat-resistant aromatic polymers (e.g., aramid fibers and phenol resin fibers) have such properties that they are carbonized without being fused, and thus it is possible to obtain carbon fibers only by forming such polymers into fibers and subjecting the resultant fibers to a high-temperature thermal treatment.

Although aramid fibers and phenol resin fibers are carbonized while maintaining their fiber shape, they have problems that their mechanical strength is poor.

That is, when only carbonization is performed while shapes are being maintained, sufficient mechanical properties (e.g., strength and elasticity) required for carbon fiber products are not developed, and thus there is still a need to develop new materials realizing sufficient mechanical properties.

Here, the present inventors previously found out a graphite film containing a heterocyclic polymer obtained through condensation between an aromatic tetracarboxylic acid and an aromatic tetraamine (see PTL 1).

However, when crystallization excessively high in two-dimensional (layer-form) orientation occurs like in a graphite film, cracks of fibers occur due to delamination in a parallel direction to graphite crystal layers bonded only via intermolecular force, and strength as fibers is problematically very weak.

CITATION LIST

Patent Literature

PTL 1: Japanese Patent Application Laid-Open (JP-A) No. 2011-57474

SUMMARY OF INVENTION

Technical Problem

The present invention aims to solve the above existing problems and achieve the following object. That is, an object of the present invention is to provide: a carbon fiber precursor fiber that can efficiently produce a carbon fiber excellent in mechanical strength without an infusibilization treatment; a carbon fiber; and a method for producing the carbon fiber.

Solution to Problem

Means for solving the above problems are as follows.

<1> A carbon fiber precursor fiber, including:

a polymer represented by General Formula (1) below:

General Formula (1)

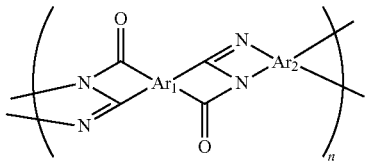

where in the General Formula (1), $Ar_1$ represents an aryl group expressed by any one of Structural Formulas (1) to (5) below, and $Ar_2$ represents an aryl group expressed by Structural Formula (6) or (7) below:

Structural Formula (1)

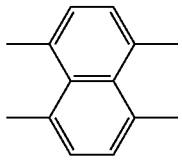

Structural Formula (2)

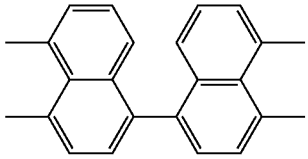

Structural Formula (3)

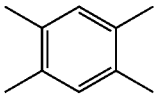

Structural Formula (4)

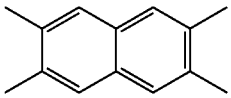

-continued

Structural Formula (5)

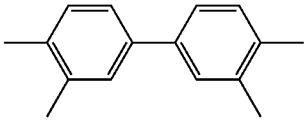

Structural Formula (6)

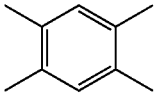

Sturctural Formula (7)

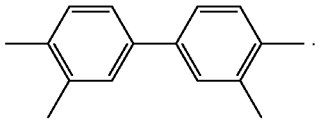

<2> A carbon fiber obtained by carbonizing the carbon fiber precursor fiber according to <1> above.

<3> A method for producing a carbon fiber, the method including:

spinning a compound to be spun containing a polymer represented by General Formula (1) below to obtain a carbon fiber precursor fiber; and heating the carbon fiber precursor fiber under inert gas to carbonize the carbon fiber precursor fiber:

General Formula (1)

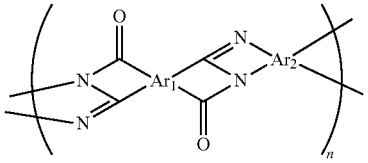

where in the General Formula (1), $Ar_1$ represents an aryl group expressed by any one of Structural Formulas (1) to (5) below, and $Ar_2$ represents an aryl group expressed by Structural Formula (6) or (7) below:

Structural Formula (1)

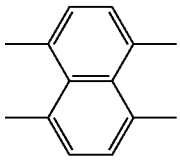

Structural Formula (2)

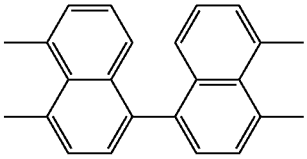

Structural Formula (3)

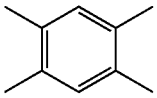

Structural Formula (4)

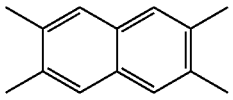

-continued

Structural Formula (5)

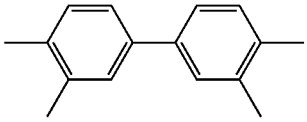

Structural Formula (6)

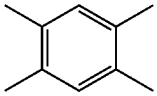

Sturctural Formula (7)

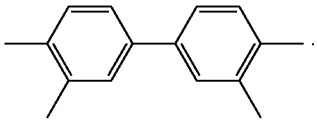

Advantageous Effects of Invention

According to the present invention, it is possible to solve the above existing problems and provide a carbon fiber precursor fiber that can efficiently produce a carbon fiber excellent in mechanical strength without an infusibilization treatment; a carbon fiber; and a method for producing the carbon fiber.

Figure 1:
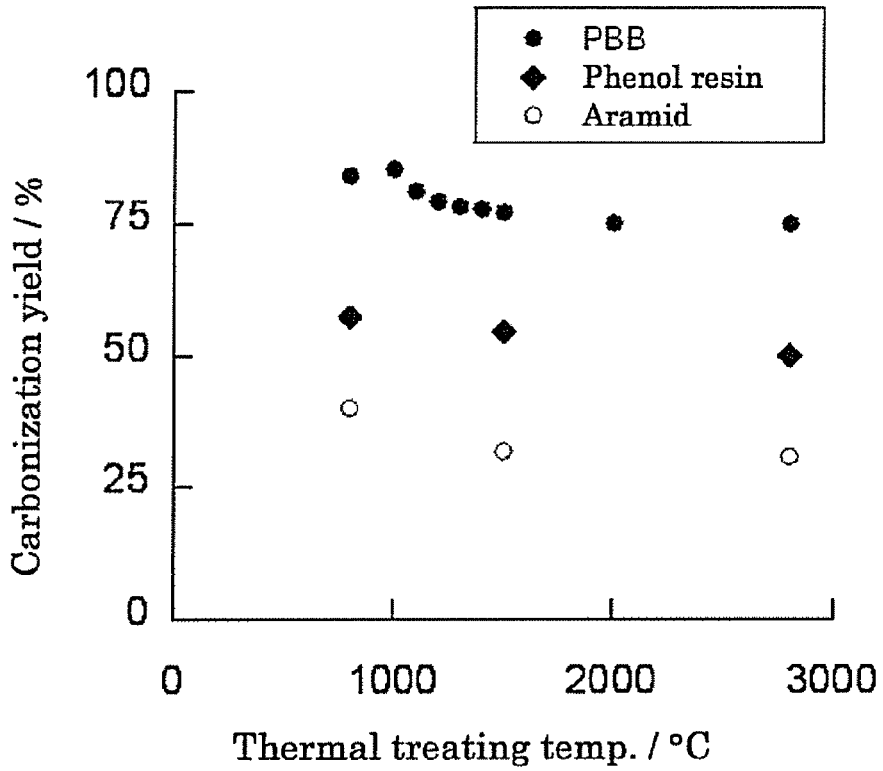
FIG. 1 is a graph indicating carbonization yields of respective carbon fibers.

DESCRIPTION OF EMBODIMENTS (Carbon Fiber Precursor Fiber and Method for Producing the Same)

A carbon fiber precursor fiber of the present invention is a fibrous material containing a polymer represented by General Formula (1) below.

General Formula (1)

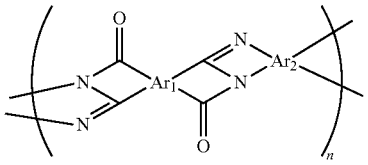

In the General Formula (1), $Ar_1$ represents an aryl group expressed by any one of Structural Formulas (1) to (5) below, and $Ar_2$ represents an aryl group expressed by Structural Formula (6) or (7) below.

Structural Formula (1)

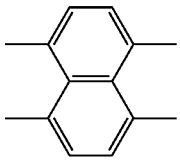

Structural Formula (2)

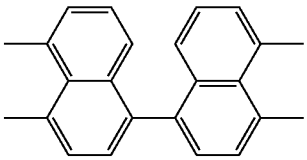

Structural Formula (3)

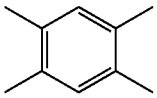

Structural Formula (4)

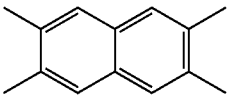

Structural Formula (5)

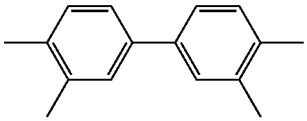

Structural Formula (6)

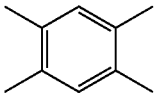

Sturctural Formula (7)

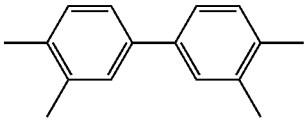

The carbon fiber precursor fiber can be carbonized while maintaining its fiber shape without an infusibilization treatment. Thereby, the carbon fiber precursor fiber can also be carbonized while maintaining the fiber axis orientation developed in the stage of the carbon fiber precursor fiber.

In addition, the carbon fiber precursor fiber can be carbonized with high carbonization yield. Thereby, it is possible to suppress distortion of structures due to pyrolysis gas generated and released during carbonization, and/or generation of voids (pores) (including foaming) which would reduce the mechanical strength of carbon fibers.

Further, although detailed reasons for this are unclear, it is possible to moderately perform both development of graphite crystals and impartment of a three-dimensional crosslinked structure, which makes it possible to produce carbon fibers having sufficient mechanical properties.

Moreover, partly because the carbonization yield is high; i.e., the amount of gas and/or tar released by pyrolysis during carbonization is small, even in the case where carbonization is rapidly performed, it is possible to avoid instant generation of a large amount of decomposition gas, which makes it possible to perform carbonization treatment very rapidly. Thereby, it is possible to carbonize thick fibers having large volumes relative to their outer surfaces so that gas is difficult to escape during carbonization.

The fibrous material contains the polymer represented by the General Formula (1).

The polymer represented by the General Formula (1) can be synthesized by the following method.

Specifically, it can be obtained by reacting, as starting materials, aromatic tetracarboxylic acid or aromatic tetracarboxylic acid derivatives, such as acid chlorides, acid anhydrides, esters or amides thereof, with aromatic tetraamine or salts thereof.

Examples of the aromatic tetracarboxylic acids include 1,4,5,8-naphthalenetetracarboxylic acid and 4,4'-binaphthy-1,1',8,8'-tetracarboxylic acid. Examples of the aromatic tetraamines include 1,2,4,5-benzenetetraamine and 3,3',4,4'-biphenyltetraamine.

In one polymerization method employable, the aromatic tetracarboxylic acid or carboxylic acid derivatives thereof and the aromatic tetraamine or salts thereof are added to a reaction vessel containing a solvent, and the mixture is stirred at 100° C. to 250° C. for 3 hours to 48 hours, to thereby obtain a polymer having a repeating unit represented by the General Formula (1).

The solvent is not particularly limited so long as it can dissolve the starting materials and formed polymers and has an effect as a catalyst of promoting polymerization. Specific examples thereof include polyphosphoric acid, polyphosphoric acid esters, and cresyl diphenyl phosphate, as well as methane sulfonic acid in which diphosphorus pentoxide or the like has been dissolved.

The 1,4,5,8-naphthalenetetracarboxylic acid can be synthesized from pyrene in 2 steps consisting of oxidation with potassium permanganate and oxidation with sodium hypochlorite solution. The 4,4'-binaphthy-1,1',8,8'-tetracarboxylic acid can be synthesized from 4-chloro-1,8,-naphthalic anhydride in 3 steps consisting of esterification, coupling, and hydrolysis. The 1,2,4,5-benzenetetraamine can be synthesized from m-chlorobenzene in 3 steps consisting of nitration, amination, and reduction of the nitro group, and isolated and used as tetrahydrochloride thereof. The 3,3',4,4'-biphenyltetraamine can be synthesized from o(ortho)-nitroaniline in 3 steps consisting of iodination, cross coupling, and reduction of the amino group.

Note that, commercially available products of them may also be purchased and used.

The carbon fiber precursor may be a fibrous material obtainable from the polymer itself, but may be a fibrous material obtainable from the polymer having the end to which any substituent has been added, so long as the effects of the present invention are not impeded.

Examples of the substituent include an ester group, an amide group, an imide group, a hydroxyl group, and a nitro group.

The carbon fiber precursor fiber can be synthesized by spinning a compound to be spun (polymer) containing the polymer represented by the General Formula (1).

An intrinsic viscosity of the compound to be spun is not particularly limited but is preferably 2.0 $dL \cdot g^{-1}$ to 10.0 $dL \cdot g^{-1}$.

When the intrinsic viscosity thereof is less than 2.0 $dL \cdot g^{-1}$, the fibers may be fractured during spinning. When it is more than 10.0 $dL \cdot g^{-1}$, the compound to be spun may not homogeneously dissolve in the below-described solvent used for spinning. Note that, 1 $dL \cdot g^{-1}$ is equivalent to $10^{-4}$ $m^3 \cdot g^{-1}$.

A method for the spinning is not particularly limited and may be appropriately selected depending on the intended purpose. Examples thereof include known wet-type spinning methods and dry-type spinning methods.

A solvent used in the wet-type spinning methods and dry-type spinning methods is not particularly limited so long as it is a solvent in which the compound to be spun can dissolve. Examples thereof include methanesufonic acid, polyphosphoric acid and concentrated sulfuric acid.

Also, a coagulation liquid for eluting the solvent and coagulating the compound to be spun as the carbon fiber precursor fiber is not particularly limited. Examples thereof include water, alcohol, aqueous methanesulfonic acid solution, aqueous polyphosphoric acid solution, and diluted sulfuric acid.

As described above, even when the carbon fiber precursor fiber is made large in its fiber diameter, the carbon fiber precursor fiber is not impaired in its shape upon the subsequent carbonization treatment. The fiber diameter thereof is not particularly limited and may be appropriately selected depending on the intended purpose. It may be 50 μm or more, if necessary. Note that, the upper limit of the fiber diameter is about 1,000 μm.

Note that, the precursor fiber may be subjected to a drawing treatment and/or a thermal treatment, if necessary. Regarding the drawing treatment, spun yarn may be drawn directly in a coagulation bath, or wound yarn may be washed with water and then drawn in the bath. Also, the drawing treatment and the thermal treatment may be performed at the same time. Regarding the thermal treatment, an atmosphere is not particularly limited, but it is preferably performed in air or in a nitrogen atmosphere. Thermal treating temperature and time may be appropriately selected, but the thermal treating temperature is preferably 200° C. to 600° C. Further, a draw ratio is preferably about 1.2 times to about 10 times.

(Carbon Fiber and Method for Producing the Same)

A carbon fiber of the present invention can be obtained by carbonizing the carbon fiber precursor fiber. Also, a method for producing the carbon fiber includes a carbonization step of heating the carbon fiber precursor fiber under inert gas to carbonize the carbon fiber precursor fiber.

The inert gas is not particularly limited, and examples thereof include nitrogen and argon gas.

In the method for producing the carbon fiber, heating in the carbonization step can be rapidly performed.

Although conditions for the heating are not particularly limited, a temperature increasing rate can be set to 5° C./min or more. Also, the upper limit of the temperature increasing rate is not particularly limited, and even when high-speed carbonization is performed by, for example, rapid heating to 1,040° C. in 0.2 seconds (at the temperature increasing rate of 5,200° C./s), it is possible to obtain the carbon fiber having excellent mechanical properties. A carbonization temperature at the time the heating is performed most is preferably 800° C. to 2,000° C. Heating at such a temperature makes it possible to carbonize the carbon fiber precursor fiber while maintaining its shape.

At this time, in the carbon fiber precursor fiber containing the polymer represented by the General Formula (1), it is possible to moderately perform both development of graphite crystals and impartment of a three-dimensional cross-linked structure, which makes it possible to produce carbon fibers having sufficient mechanical properties.

Also, in order to control the mechanical properties (e.g., strength and elasticity) of the carbon fiber obtained by the carbonization, the method for producing the carbon fiber may include, after the carbonization step or successively with the carbonization step, a graphitizing step of heating the carbon fiber at a higher temperature to graphitize the carbon fiber.

A heating temperature in the graphitizing step (a heating step to be performed successively with the carbonization step in some cases) is not particularly limited but is preferably 2,000° C. to 3,200° C. Setting the heating temperature in such a range makes it possible to produce the carbon fibers having sufficient mechanical properties at high carbonization yield and high density.

Note that, the graphitizing step is preferably performed under the inert gas similar to the carbonization step.

Note that, the method for producing the carbon fiber may further include steps of performing a surface treatment and a sizing impartment, which are performed in known carbon fiber production processes.

EXAMPLES

Example 1

PBB Carbon Fiber

—Synthesis of Precursor Fiber for PBB Carbon Fiber—

4-Chloro-1,8-naphthalic anhydride (product of Alfa Aesar Co., Distributor Code: No. L05508) was allowed to undergo an esterification treatment, a coupling treatment, and a hydrolysis treatment in this order in accordance with the following Synthesis Scheme (1), to thereby synthesize 4,4'-binaphthy-1,1',8,8'-tetracarboxylic acid (hereinafter abbreviated as "BNTCA").

Synthesis Scheme (1)

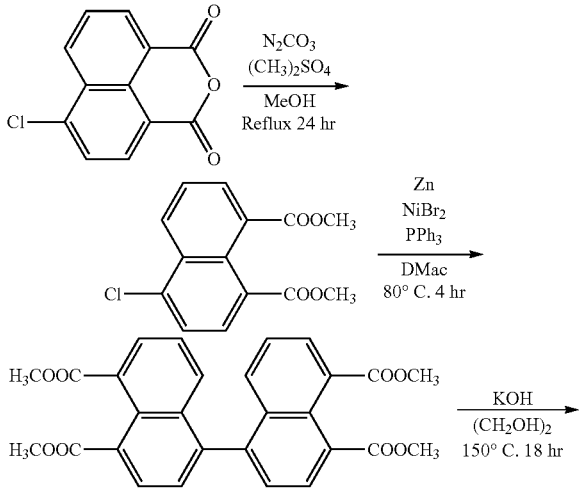

-continued

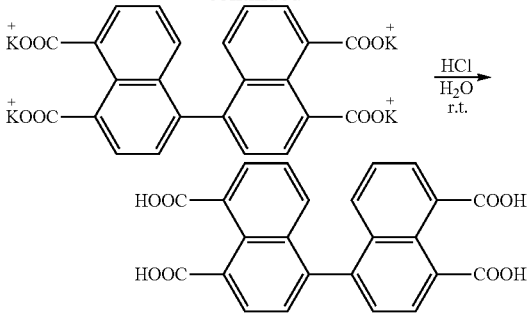

4,4'-Binaphthy-1,1',8,8'-tetracarboxylic acid (BNTCA)

Note that, "DMAc" in the Synthesis Scheme (1) means dimethyl acetoamide.

Next, in accordance with the following Synthesis Scheme (2), equimolar amounts of BNTCA and 4,4'-biphenyl-1,1',2,2'-tetraamine (product of Aldrich Co., Distributor Code: No. D12384, hereinafter abbreviated as "BPTA") were added to polyphosphoric acid (product of Sigma-Aldrich Co., Distributor Code: No. 208213, hereinafter abbreviated as "PPA") and were allowed to undergo polycondensation, to thereby synthesize poly[bis-(benzimidazoisoquinoline)] (hereinafter abbreviated as "PBB").

Synthesis Scheme (2)

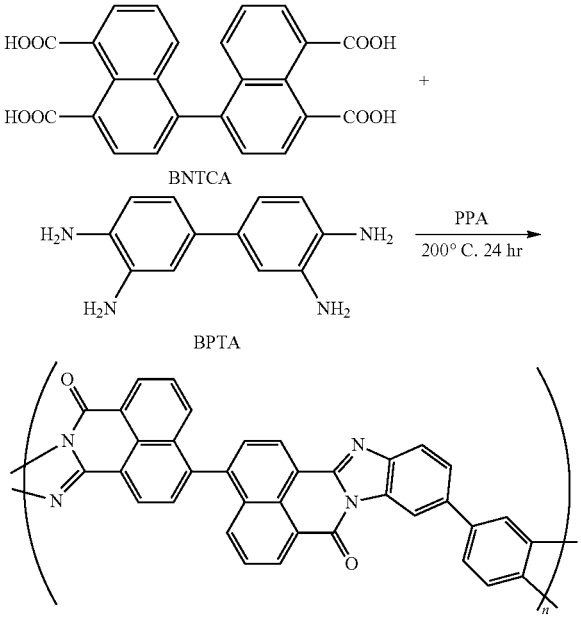

Next, 1.0 g of the synthesized PBB was dissolved in 20 mL of methanesulfonic acid (product of Wako Pure Chemical Industries, Co., Distributor Code: No. 138-01576, hereinafter abbreviated as "MSA") to prepare a raw liquid for spinning.

The raw liquid for spinning was introduced to a wet-type spinning device, and was wet-spun under the following conditions: nozzle diameter: 0.25 mm, discharge linear velocity: 3.2 m/min, and winding speed: 4.8 m/min (jet stretch ratio: 1.5).

The spun fiber was dried for one day in a hot-air, warm-air furnace of 60° C., and dried for one hour in a nitrogen atmosphere of 400° C. to obtain a carbon fiber precursor fiber of PBB (hereinafter abbreviated as "PBB carbon fiber precursor fiber). Note that, the obtained PBB carbon fiber precursor fiber was found to have a fiber diameter of 50 μm.

Example 1-1

Carbonization

—Carbonization Treatment—

The PBB carbon fiber precursor fiber was carbonized by being rapidly increased in temperature from room temperature to 1,000° C. for 10 minutes in a nitrogen atmosphere, to thereby produce a carbon fiber according to Example 1-1. Note that, this carbonization treatment was performed in a state where no tension was applied to the PBB carbon fiber precursor fiber.

The carbon fiber obtained at this rapid temperature increasing rate was not fused or burned out at all, and the fiber shape of the PBB carbon fiber precursor fiber was maintained, which makes it possible to remarkably shorten the required time for the production.

Example 1-2 to Example 1-10

Carbonization Conditions

Carbon fibers according to Example 1-2 to Example 1-8 were produced in the same manner as in Example 1-1 except that the carbonization treatment in Example 1-1 was changed to a carbonization treatment of increasing the precursor fiber from room temperature to a predetermined temperature at a temperature increasing rate of 10° C./min in a nitrogen atmosphere and maintaining the temperature-increased state for one hour.

Here, the carbon fibers according to Example 1-2 to Example 1-8 are carbon fibers that were produced by changing the final temperature in the temperature range of 800° C. to 1,500° C. Specifically, the carbonization temperatures of the carbon fibers according to Example 1-2 to Example 1-8 were increased in increments of 100° C. in the order of Example 1-2 to Example 1-8.

In addition, carbon fibers according to Example 1-9 and Example 1-10, which are Examples where the carbonization temperatures exceed 1,500° C., were produced in the same manner as in Example 1-1 except that the carbonization treatment in Example 1-1 was changed to a carbonization treatment of increasing the precursor fiber from room temperature to a predetermined temperature at a temperature increasing rate of 20° C./min in a nitrogen atmosphere and maintaining the temperature-increased state for 30 minutes.

Here, the carbon fiber according to Example 1-9 is a carbon fiber that was produced with the carbonization temperature being 2,000° C., and the carbon fiber according to Example 1-10 is a carbon fiber that was produced with the carbonization temperature (graphitization temperature) being 2,800° C.

Note that, the carbon fibers according to Examples 1-1 to 1-10 will be referred to as PBB carbon fibers, hereinafter.

Comparative Example 1

Aramid Carbon Fiber

A carbon fiber according to Comparative Example 1-1 using an aramid fiber as a precursor was produced in the same manner as in Example 1-2 except that the PBB carbon fiber precursor fiber in Example 1-2 (carbonization temperature: 800° C.) was changed to an aramid fiber (product of DU PONT-TORAY Co., Kevlar (registered trademark)).

Also, a carbon fiber according to Comparative Example 1-2 using an aramid fiber as a precursor was produced in the same manner as in Example 1-8 except that the PBB carbon fiber precursor fiber in Example 1-8 (carbonization temperature: 1,500° C.) was changed to an aramid fiber (product of DU PONT-TORAY Co., Kevlar (registered trademark)).

Also, a carbon fiber according to Comparative Example 1-3 using an aramid fiber as a precursor was produced in the same manner as in Example 1-10 except that the PBB carbon fiber precursor fiber in Example 1-10 (carbonization temperature: 2,800° C.) was changed to an aramid fiber (product of DU PONT-TORAY Co., Kevlar (registered trademark)).

Note that, the carbon fibers according to Comparative Examples 1-1 to 1-3 will be referred to as aramid carbon fibers, hereinafter.

Comparative Example 2

Phenol Resin Carbon Fiber

A carbon fiber according to Comparative Example 2-1 using a phenol resin fiber as a precursor was produced in the same manner as in Example 1-2 except that the PBB carbon fiber precursor fiber in Example 1-2 (carbonization temperature: 800° C.) was changed to a phenol resin fiber (product of Gunei Chemical Industry Co., Kynol (registered trademark)).

Also, a carbon fiber according to Comparative Example 2-2 using a phenol resin fiber as a precursor was produced in the same manner as in Example 1-8 except that the PBB carbon fiber precursor fiber in Example 1-8 (carbonization temperature: 1,500° C.) was changed to a phenol resin fiber (product of Gunei Chemical Industry Co., Kynol (registered trademark)).

Also, a carbon fiber according to Comparative Example 2-3 using a phenol resin fiber as a precursor was produced in the same manner as in Example 1-10 except that the PBB carbon fiber precursor fiber in Example 1-10 (carbonization temperature: 2,800° C.) was changed to a phenol resin fiber (product of Gunei Chemical Industry Co., Kynol (registered trademark)).

Note that, the carbon fibers according to Comparative Examples 2-1 to 2-3 will be referred to as phenol resin carbon fibers, hereinafter.

Note that, the aramid fibers used in Comparative Examples 1-1 to Comparative Example 1-3 and the phenol resin fibers used in Comparative Example 2-1 to Comparative Example 2-3 are commercially available as heat-resistant (infusible)-flame retardant fibers, but are precursor fibers that can be carbonized without an infusibilization treatment.

(Properties and Evaluation of Carbon Fibers)

—Carbonization Yield—

FIG. 1 indicates carbonization yields of the carbon fibers calculated from the weights of the carbon fiber precursor fibers used for production of the carbon fibers and from the weights of the obtained carbon fibers.

In FIG. 1, the carbonization yields of the PBB carbon fiber according to Example 1-2 (carbonization temperature: 800° C.), the PBB carbon fiber according to Example 1-8 (carbonization temperature: 1,500° C.), and the PBB carbon fiber according to Example 1-10 (carbonization temperature: 2,800° C.) are 84.2% (Example 1-2), 77.3% (Example 1-8), and 75.1% (Example 1-10). These carbonization yields are very high values considering that carbonization yields of PAN-type carbon fibers needing an infusibilization treatment are about 50%.

Also, in FIG. 1, the carbonization yields of the aramid fiber according to Comparative Example 1-1 (carbonization temperature: 800° C.), the aramid fiber according to Comparative Example 1-2 (carbonization temperature: 1,500° C.), and the aramid fiber according to Comparative Example 1-3 (carbonization temperature: 2,800° C.) are 40.0% (Comparative Example 1-1), 31.9% (Comparative Example 1-2), and 30.8% (Comparative Example 1-3). The carbonization yields of the PBB carbon fibers according to Examples 1-2, 1-8 and 1-10 are much higher values than those of the aramid carbon fibers according to Comparative Examples 1-1, 1-2 and 1-3.

Also, in FIG. 1, the carbonization yields of the phenol resin carbon fiber according to Comparative Example 2-1 (carbonization temperature: 800° C.), the phenol resin carbon fiber according to Comparative Example 2-2 (carbonization temperature: 1,500° C.), and the phenol resin carbon fiber according to Comparative Example 2-3 (carbonization temperature: 2,800° C.) are 57.2% (Comparative Example 2-1), 54.5% (Comparative Example 2-2), and 50.0% (Comparative Example 2-3). The carbonization yields of the PBB carbon fibers according to Examples 1-2, 1-8 and 1-10 are much higher values than those of the phenol resin carbon fibers according to Comparative Examples 2-1, 2-2 and 2-3.

—Density—

Figure 2:
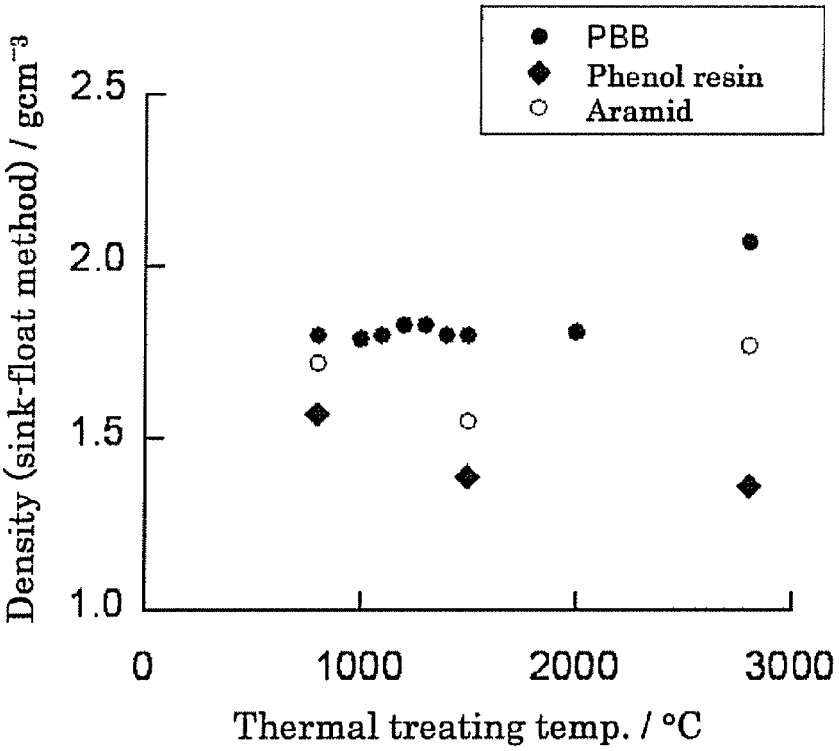
FIG. 2 is a graph indicating densities of respective carbon fibers.

FIG. 2 indicates densities of the carbon fibers calculated by the sink-float method.

In FIG. 2, the densities of the PBB carbon fiber according to Example 1-2 (carbonization temperature: 800° C.), the PBB carbon fiber according to Example 1-8 (carbonization temperature: 1,500° C.), and the PBB carbon fiber according to Example 1-10 (carbonization temperature: 2,800° C.) are 1.8 g/cm$^3$ (Example 1-2), 1.8 g/cm$^3$ (Example 1-8), and 2.0 g/cm$^3$ (Example 1-10).

Also, in FIG. 2, the densities of the aramid fiber according to Comparative Example 1-1 (carbonization temperature: 800° C.), the aramid fiber according to Comparative Example 1-2 (carbonization temperature: 1,500° C.), and the aramid fiber according to Comparative Example 1-3 (carbonization temperature: 2,800° C.) are 1.7 g/cm$^3$ (Comparative Example 1-1), 1.5 g/cm$^3$ (Comparative Example 1-2), and 1.8 g/cm$^3$ (Comparative Example 1-3).

Also, in FIG. 2, the densities of the phenol resin carbon fiber according to Comparative Example 2-1 (carbonization temperature: 800° C.), the phenol resin carbon fiber according to Comparative Example 2-2 (carbonization temperature: 1,500° C.), and the phenol resin carbon fiber according to Comparative Example 2-3 (carbonization temperature: 2,800° C.) are 1.6 g/cm$^3$ (Comparative Example 2-1), 1.4 g/cm$^3$ (Comparative Example 2-2), and 1.3 g/cm$^3$ (Comparative Example 2-3).

As indicated above, under all of the conditions that the carbonization temperatures in the carbonization treatment are 800° C., 1,500° C. and 2,800° C., the PBB carbon fibers have higher densities than the aramid carbon fibers and the phenol resin carbon fibers. Also, considering that the densities of commercially available PAN-type carbon fibers and pitch-type carbon fibers, which are produced at a carbonization temperature of 1,500° C. in a carbonization treatment, are higher than 1.7 g/cm$^3$, the aramid carbon fiber (1.5 g/cm$^3$) and the phenol resin carbon fiber (1.4 g/cm$^3$) have lower densities, indicating that they have loose structures. In contrast, the PBB carbon fiber (1.8 g/cm$^3$) has a density comparable to the PAN-type carbon fiber and the pitch-type carbon fiber, indicating that it has a dense structure.

—Strength and Elasticity—

Strength and elasticity of a carbon fiber depend on crystallinity and orientation of graphite crystals constituting the carbon fiber.

Figure 3A:
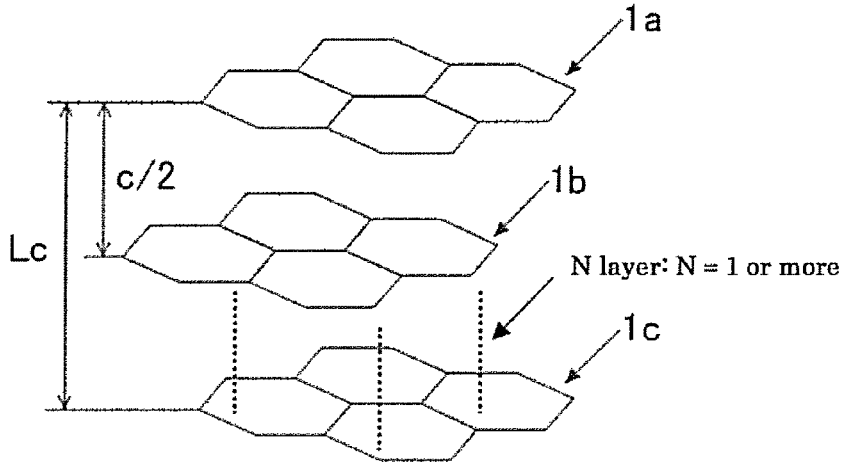
FIG. 3A is a conceptual diagram indicating plane interval c/2 of carbon network planes and stack thickness $L_c$ of carbon network planes in a graphite crystal.

Here, first, plane interval c/2 of carbon network planes and stack thickness $L_c$ of carbon network planes were measured as parameters indicating crystallinity of graphite crystals. FIG. 3A is a conceptual diagram indicating plane interval c/2 of carbon network planes and stack thickness $L_c$ of carbon network planes in a graphite crystal. Note that, reference signs 1*a*, 1*b* and 1*c* in FIG. 3A denote carbon network planes.

Figure 3B:
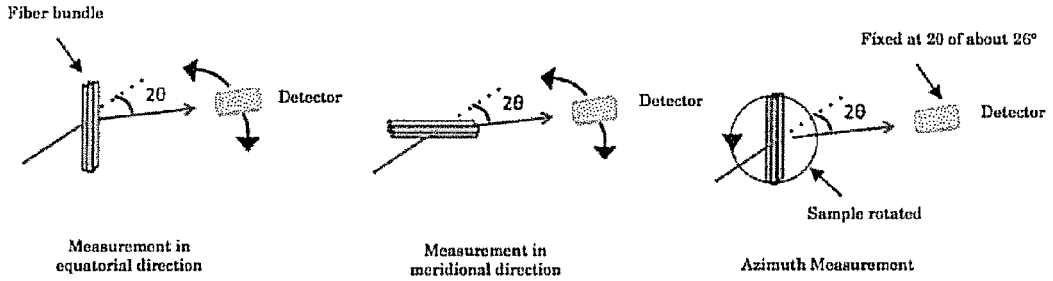
FIG. 3B is a conceptual diagram indicating an optical system in measuring wide angle X-ray diffraction.

The measurement of the plane interval c/2 of carbon network planes and the stack thickness $L_c$ of carbon network planes was performed by measuring a wide angle X-ray diffraction profile with an X-ray diffraction device using CuKα rays monochromatized with a Ni filter as an X-ray source. Specifically, in the optical system for an equatorial direction illustrated in FIG. 3B, the plane interval c/2 of carbon network planes and the stack thickness $L_c$ of carbon network planes were obtained from the peak of plane index (002) observed at 2θ of about 26° in the equatorial direction profile. Note that, FIG. 3B is a conceptual diagram indicating an optical system in measuring a wide angle X-ray diffraction profile, where the equatorial direction is a direction in which the detector is perpendicular to the fiber axis and the meridional direction is a direction in which the detector is in parallel with the fiber axis. Further, azimuth measurement is performed by rotating the fiber from the meridional direction via the equatorial direction to the meridional direction to obtain a profile of its X-ray intensity distribution in a state where the detector is fixed at 2θ of about 26° using the X-ray diffraction device.

Next, orientation degree f of the graphite crystals obtained from the above-described azimuth measurement is used as an index of a carbon fiber having practical strength and elastic modulus. Note that, this orientation degree f is referred to as a practical orientation degree, and in the case of carbon materials, it is calculated from the formula: $f=(1-H°/180)\times 100$, where (H°) denotes a full-width at half maximum of the intensity distribution measured along a so-called Debye ring of the 002 plane reflection of the graphite crystals observed at 2θ of about 26°. In FIG. 3A, the case where f=100 means that the carbon crystal network planes are all arranged in the fiber axis direction, and the case where f=0 means that the carbon crystal network planes are arranged randomly with respect to the fiber axis direction.

Table 1 below presents the plane interval c/2 of the carbon network planes, the stack thickness $L_c$ of the carbon network planes, and the orientation degrees (f) of the graphite crystals in the PBB carbon fiber according to Example 1-8, the aramid carbon fiber according to Comparative Example 1-2, and the phenol resin carbon fiber according to Comparative Example 2-2, which were carbonized at the carbonization temperature of 1,500° C., and the PAN-type carbon fiber and the pitch-type carbon fiber, which are disclosed in Referential Document 1.

Referential Document 1; A. Takaku, et al., J. Mater. Sci., 25, 4873 (1990)

TABLE 1

| | c/2 (nm) | $L_c$ (nm) | f (%) |
|---|---|---|---|
| PBB carbon fiber (Ex. 1-8) | 0.346 | 2.56 | 82.1 |
| Aramid carbon fiber (Comp. Ex. 1-2) | 0.356 | 1.46 | 75.0 |
| Phenol carbon fiber (Comp. Ex. 2-2) | 0.368 | 1.22 | 35.0 |
| PAN-type carbon fiber (Referential Document 1) | 0.350 | 2.31 | 84.2 |
| Pitch-type carbon fiber (Referential Document 1) | 0.351 | 4.93 | 79.5 |

As presented in the above Table 1, the PBB carbon fiber according to Example 1-8 exhibits the plane interval c/2 of the carbon network planes and the stack thickness $L_c$ of the carbon network planes that are comparable to those of the PAN-type carbon fiber needing an infusibilization treatment and the like, and has excellent crystallinity, and also the orientation degree f of the graphite crystals thereof is higher than 80%, which is comparable to that of the PAN-type carbon fiber and is higher than that of the pitch-type carbon fiber similarly needing an infusibilization treatment and the like.

Meanwhile, the aramid carbon fiber according to Comparative Example 1-2 and the phenol fiber carbon fiber according to Comparative Example 2-2, which have not undergone an infusibilization treatment and the like, are lower than the PBB carbon fiber according to Example 1-8 in the plane interval c/2 of the carbon network planes and the stack thickness $L_c$ of the carbon network planes, and have poor crystallinity. In addition, the values of the orientation degrees f are also low, and thus these are not satisfactory as practical carbon fibers.

As described above, the present invention can provide a carbon fiber having excellent strength and elasticity without treatments such as an infusibilization treatment, and a method for producing the same.

Example 2

PBB Fiber

In Example 1, the PBB carbon fiber precursor fiber having the large fiber diameter of 50 μm was produced. As an alternative method, next will be described a method for producing a PBB carbon fiber precursor fiber having a small diameter using a wet-type spinning device having a multi hose nozzle.

Specifically, the raw liquid for spinning was introduced to a wet-type spinning device provided with a multi hose nozzle having 400 holes each having a hole diameter of 0.06 mm instead of the wet-type spinning device in Example 1, and was wet-spun under the following conditions: discharge linear velocity: 1.0 m/min and winding speed: 1.5 m/min (jet stretch ratio: 1.5). The other procedure was performed in the same manner as in Example 1 to obtain a PBB carbon fiber precursor fiber according to Example 2. Note that, the fiber diameter of the obtained PBB carbon fiber precursor fiber was found to be 15 μm.

This PBB carbon fiber precursor fiber according to Example 2 was subjected to a carbonization treatment of increasing its temperature from room temperature to 1,500° C. at a temperature increasing rate of 10° C./min and maintaining it for 10 minutes in a nitrogen atmosphere, to thereby produce a carbon fiber according to Example 2-1. Note that, this carbonization treatment was performed in a state where a tension of 10 MPa was applied to the PBB carbon fiber precursor fiber.

This carbon fiber according to Example 2-1 was found to have a density of 1.8 g/cm$^3$, plane interval c/2 of 0.349 nm, stack thickness $L_c$ of 1.86 nm, and orientation degree f of 80.8%, indicating that it could exhibit properties substantially equivalent to those of the carbon fiber having the large diameter according to Example 1-8.

Also, from the viewpoint of rapid carbonization, next will be described an example where carbonization was performed at a rapid temperature increasing rate.

Specifically, the PBB carbon fiber precursor fiber according to Example 2 was subjected to a carbonization treatment of increasing its temperature from room temperature to 1,040° C. in 0.2 seconds and maintaining it for 5 seconds in a nitrogen atmosphere using a Curie point pyrolyzer (product of Japan Analytical Industry, Co.), to thereby produce a carbon fiber according to Example 2-2. Note that, this carbonization treatment was performed in a state where no tension was applied to the PBB carbon fiber precursor fiber.

Comparative Example 4 and Comparative Example 5

Aramid Carbon Fiber and Phenol Resin Carbon Fiber

As comparisons regarding the rapid carbonization, a carbon fiber according to Comparative Example 4 using an aramid fiber as a precursor and a carbon fiber according to Comparative Example 5 using a phenol resin fiber as a precursor were produced in the same manner as in Example 2-2 except that the PBB carbon fiber precursor fiber according to Example 2 was changed to an aramid carbon fiber (product of DU PONT-TORAY Co., Kevlar (registered trademark)) or a phenol resin fiber (product of Gunei Chemical Industry Co., Kynol (registered trademark)).

Figure 4A:
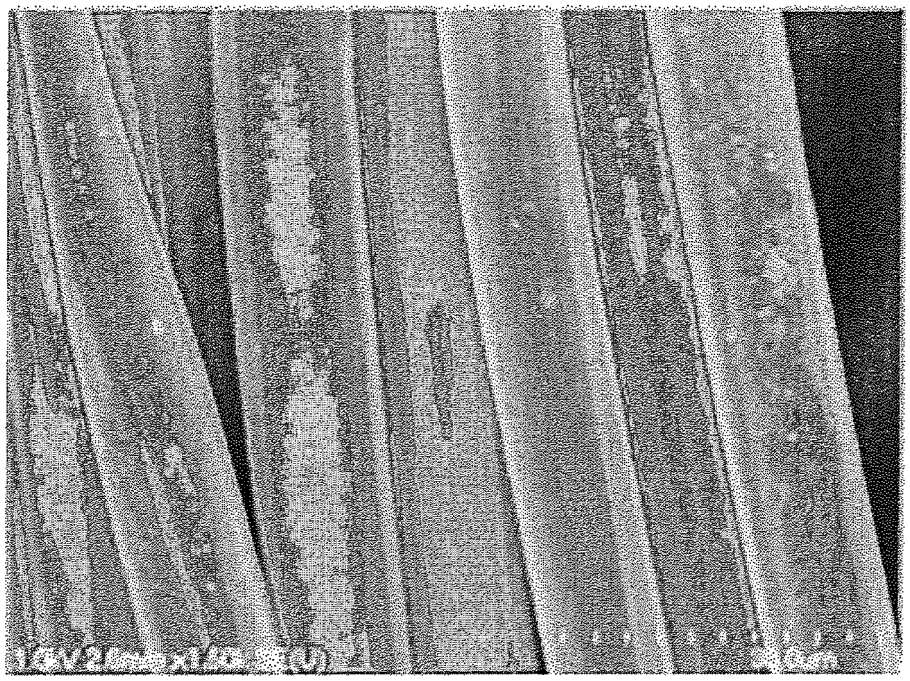
FIG. 4A is an image of side surfaces of carbon fibers (PBB carbon fibers) according to Example 2-2 which are photographed with a scanning microscope.
Figure 4B:
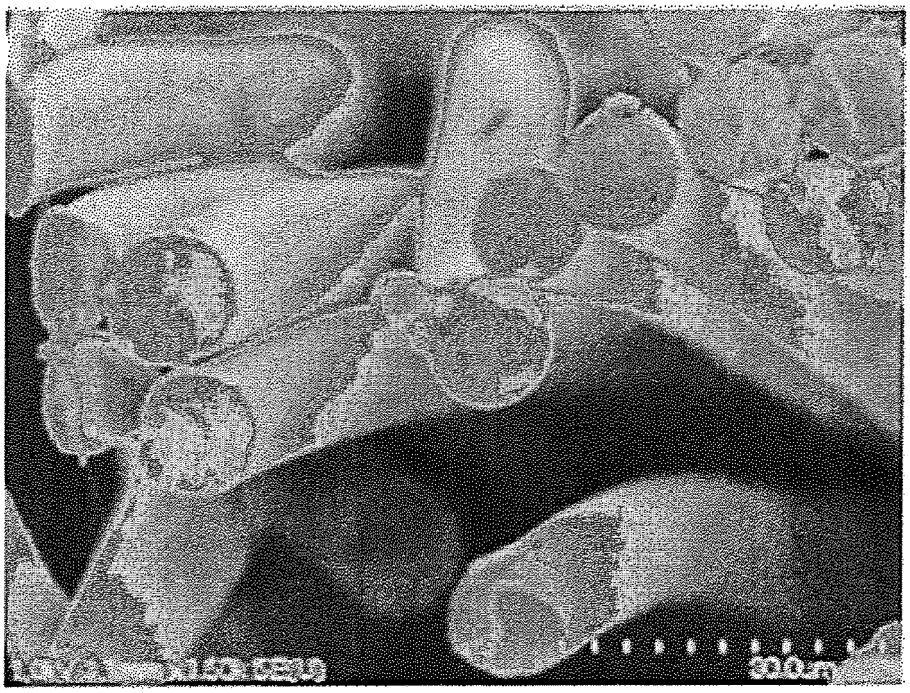
FIG. 4B is an image of cross-sectional surfaces of carbon fibers (PBB carbon fibers) according to Example 2-2 which are photographed with a scanning microscope.

FIG. 4A is an image of side surfaces of carbon fibers (PBB carbon fibers) according to Example 2-2 which were photographed with a scanning microscope, and FIG. 4B is an image of cross-sectional surfaces thereof which were photographed with a scanning microscope.

Figure 5A:
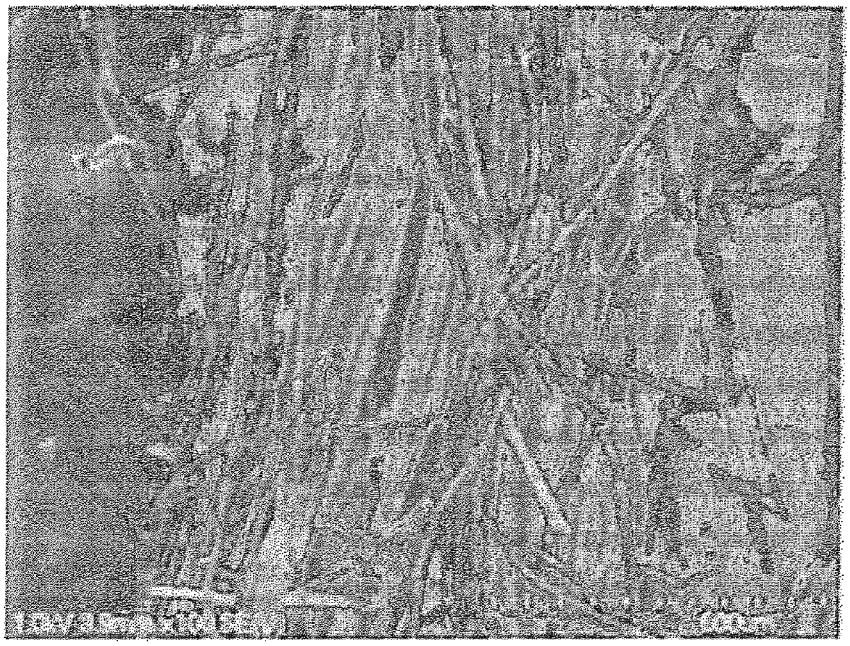
FIG. 5A is an image of side surfaces of carbon fibers (aramid carbon fibers) according to Comparative Example 4 which are photographed with a scanning microscope.
Figure 5B:
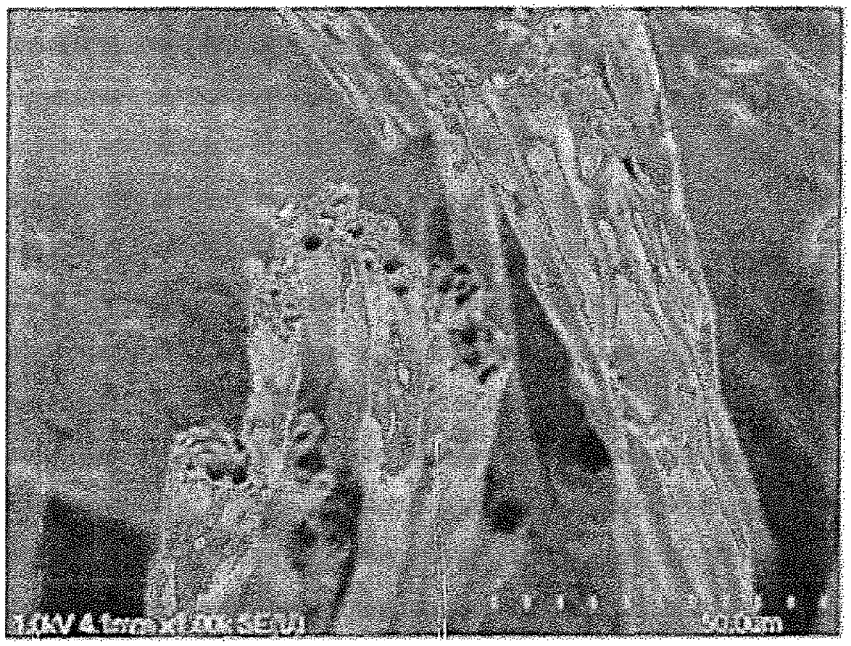
FIG. 5B is an image of cross-sectional surfaces of carbon fibers (aramid carbon fibers) according to Comparative Example 4 which are photographed with a scanning microscope.

Also, FIG. 5A is an image of side surfaces of the carbon fibers (aramid carbon fibers) according to Comparative Example 4 which were photographed with a scanning microscope, and FIG. 5B is an image of cross-sectional surfaces thereof which were photographed with a scanning microscope.

Figure 6A:
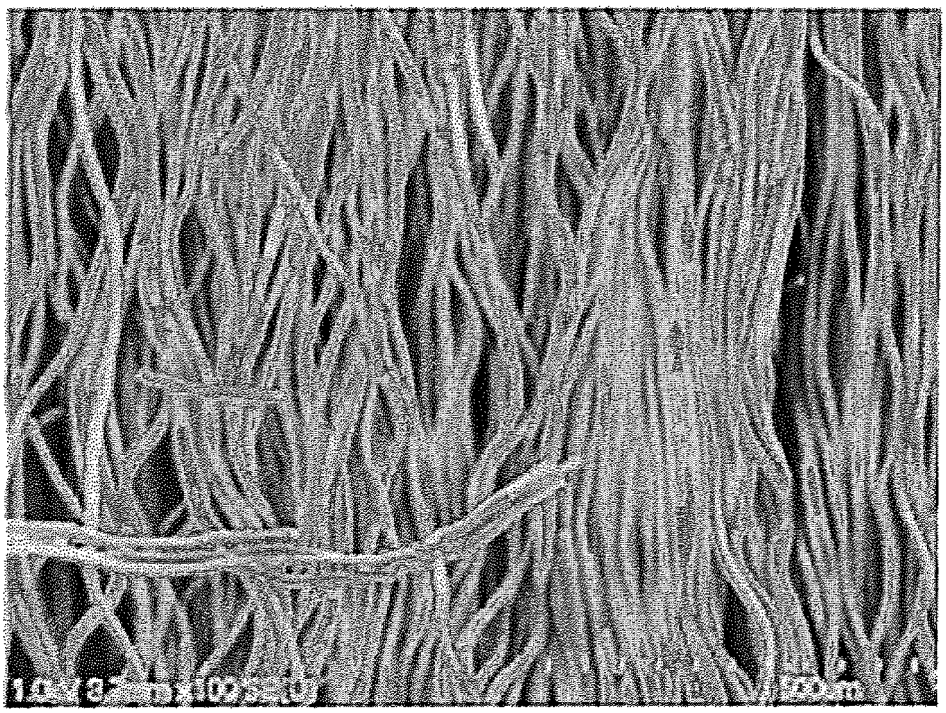
FIG. 6A is an image of side surfaces of carbon fibers (phenol resin carbon fibers) according to Comparative Example 5 which are photographed with a scanning microscope.
Figure 6B:
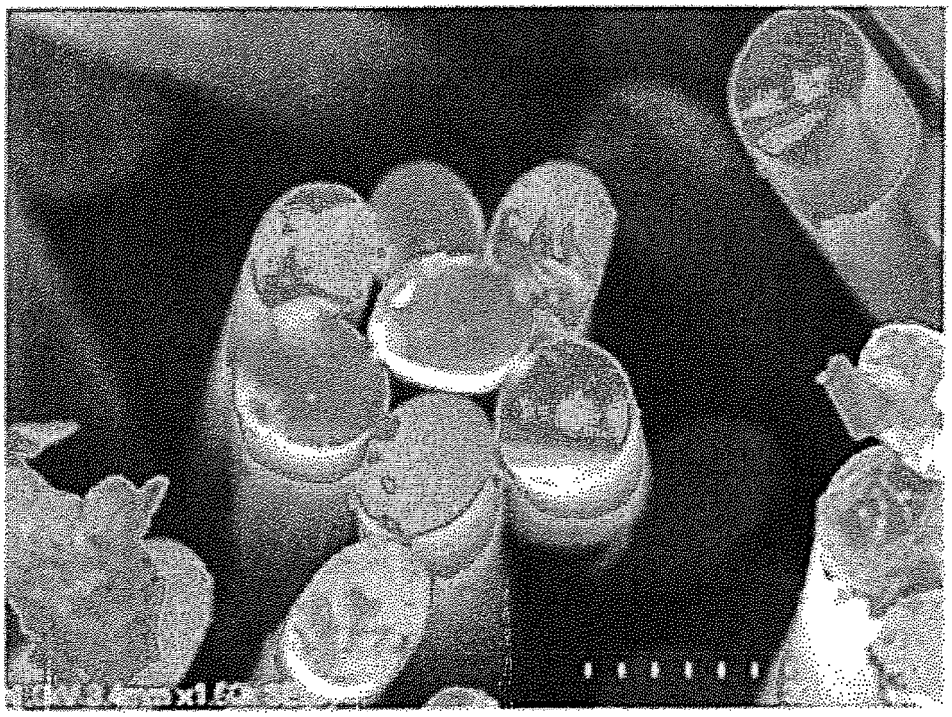
FIG. 6B is an image of cross-sectional surfaces of carbon fibers (phenol resin carbon fibers) according to Comparative Example 5 which are photographed with a scanning microscope.

Also, FIG. 6A is an image of side surfaces of the carbon fibers (phenol resin carbon fibers) according to Comparative Example 5 which were photographed with a scanning microscope, and FIG. 6B is an image of cross-sectional surfaces thereof which were photographed with a scanning microscope.

As illustrated in FIGS. 4A and 4B, the carbon fibers (PBB carbon fibers) according to Example 2-2 were not fused at all even when subjected to the rapid carbonization treatment, and they could be carbonized while maintaining the fiber shape of the PBB carbon fiber precursor fibers.

Also, the obtained carbon fiber was found to have a density of 1.8 g/cm$^3$, which is not different from that of the carbon fiber according to Example 2-1.

Meanwhile, as illustrated in FIGS. 5A and 5B, the carbon fibers (aramid carbon fibers) according to Comparative Example 4 were fused on the fiber surfaces. In addition, traces of being ruptured and burnt out were observable even inside the fibers. The density thereof was found to be low; i.e., 1.6 g/cm$^3$.

Also, as illustrated in FIGS. 6A and 6B, the carbon fibers (phenol resin carbon fibers) according to Comparative Example 5 were not fused or ruptured, but the density thereof was found to be the lowest; i.e., 1.5 g/cm$^3$.

Note that, although PAN-type carbon fibers are not illustrated, it is reported that when they are carbonized at high temperature increasing rates, the fiber interior ruptures due to rapid gas expansion derived from rapid heating during the carbonization step, and the fiber interior derived from a skin-core structure is burnt out to be hollow (see Referential Documents 1 and 2 below).

Referential Document 1: Hiroyasu Ogawa, Journal of the Chemical Society of Japan, 1994, No. 10, 927-932

Referential Document 2: Hiroyasu Ogawa, Journal of the Chemical Society of Japan, 1994, No. 5, 464-467

Therefore, use of the carbon fiber precursor of the present invention can produce carbon fibers having sufficient properties even when a very rapid carbonization treatment is performed, which makes it possible to remarkably shorten the required time for production to enable efficient production.

REFERENCE SIGNS LIST

1*a*, 1*b*, 1*c* carbon network planes c/2 plane interval of carbon network planes $L_c$ stack thickness of carbon network planes

What is claimed is:

1. A carbon fiber precursor fiber, comprising:

a polymer represented by General Formula (1) below:

General Formula (1)

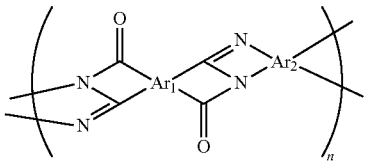

where in the General Formula (1), $Ar_1$ represents an aryl group expressed by any one of Structural Formulas (2) or (5) below, and $Ar_2$ represents an aryl group expressed by Structural Formula (6) or (7) below:

Structural Formula (2)

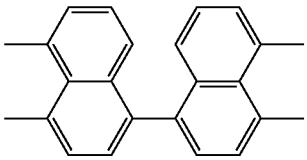

Structural Formula (5)

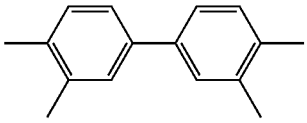

Structural Formula (6)

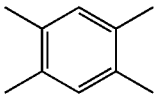

-continued

Structural Formula (7)

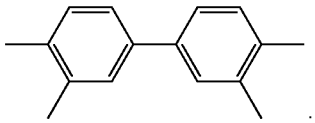

2. A carbon fiber obtained by carbonizing a carbon fiber precursor fiber comprising a polymer represented by General Formula (1) below:

General Formula (1)

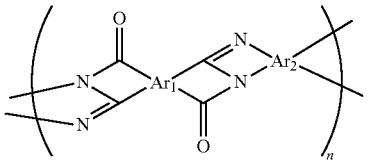

where in the General Formula (1), Arl represents an aryl group expressed by any one of Structural Formulas (1) to (3) or (5) below, and Ar2 represents an aryl group expressed by Structural Formula (6) or (7) below, except for a combination in which Ar1is the aryl group expressed by Structural Formula (1) or Structural Formula (3) and Ar2 is the aryl group expressed by Structural Formula (6) or a combination in which Ar1 is the aryl group expressed by Structural Formula (3) and Ar2 is the aryl group expressed by Structural Formula (7):

Structural Formula (1)

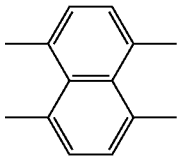

Structural Formula (2)

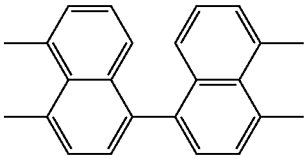

Structural Formula (3)

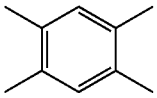

Structural Formula (5)

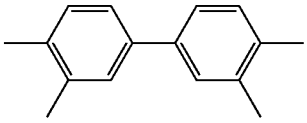

Structural Formula (6)

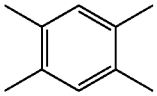

-continued

Sturctural Formula (7)

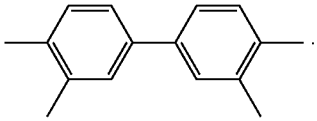

3. A method for producing a carbon fiber, the method comprising:

spinning a compound to be spun containing a polymer represented by General Formula (1) below to obtain a carbon fiber precursor fiber; and heating the carbon fiber precursor fiber under inert gas to carbonize the carbon fiber precursor fiber:

General Formula (1)

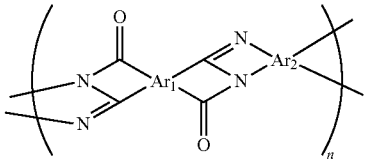

where in the General Formula (1), $Ar_1$ represents an aryl group expressed by any one of Structural Formulas (1) to (3) or (5) below, and $Ar_2$ represents an aryl group expressed by Structural Formula (6) or (7) below, except for a combination in which $Ar_1$ is the aryl group expressed by Structural Formula (1) or Structural Formula (3) and $Ar_2$ is the aryl group expressed by Structural Formula (6) or a combination in which Ar1 is the aryl group expressed by Structural Formula (3) and Ar2 is the aryl group expressed by Structural Formula (7):

Structural Formula (1)

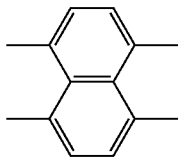

Structural Formula (2)

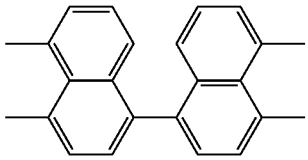

Structural Formula (3)

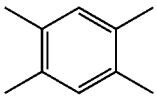

Structural Formula (5)

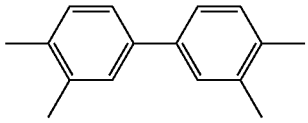

Structural Formula (6)

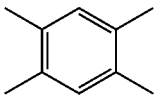

-continued

Sturctural Formula (7)

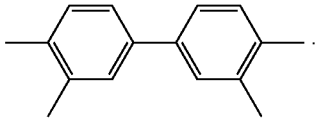

4. The method for producing a carbon fiber according to claim 3, wherein an intrinsic viscosity of the compound to be spun is 2.0 $dL^{-1}$ to 10.0 $dL^{-1}$.

5. The method for producing a carbon fiber according to claim 3, wherein the carbon fiber precursor fiber is subjected to a drawing treatment.

6. The method for producing a carbon fiber according to claim 3, wherein the carbon fiber precursor fiber is subjected to a thermal treatment.

7. The method for producing a carbon fiber according to claim 3, wherein the inert gas is nitrogen or argon gas.

8. The method for producing a carbon fiber according to claim 3, further comprising: after the heating the carbon fiber precursor fiber, heating the carbon fiber at a higher temperature to graphitize the carbon fiber.

* * * * *